US005899448A

United States Patent [19]

Hosking

[11] Patent Number: 5,899,448

[45] Date of Patent: May 4, 1999

[54] SHEET FEEDING APPARATUS AND METHOD

[75] Inventor: Steven Michael Hosking, Hants, United Kingdom

[73] Assignee: De La Rue International Limited, United Kingdom

[21] Appl. No.: 08/687,799

[22] Filed: Jul. 19, 1996

[30] Foreign Application Priority Data

Jul. 27, 1995 [GB] United Kingdom ..... 9515437

[51] Int. Cl.[6] ..... B65H 5/22

[52] U.S. Cl. ..... 271/3.08; 271/3.01; 271/110; 271/126; 271/153; 271/154; 271/155; 271/315

[58] Field of Search ..... 271/3.01, 3.08, 271/3.13, 3.14, 3.15, 94, 10.03, 103, 109, 110, 112, 119, 120, 126, 139, 140, 227, 152, 153, 154, 155, 158, 159, 178, 187, 315, 213, 214, 215, 217

[56] References Cited

U.S. PATENT DOCUMENTS

| | | | |
|---|---|---|---|
| 4,465,193 | 8/1984 | Kokubo et al. | 209/3.1 |
| 4,639,582 | 1/1987 | Arikawa et al. . | |
| 4,678,175 | 7/1987 | Arldt et al. | 271/34 |
| 4,718,655 | 1/1988 | Okayama et al. | 271/3.1 |
| 5,098,080 | 3/1992 | Arnone et al. | 271/187 |
| 5,169,140 | 12/1992 | Wenthe, Jr. . | |
| 5,518,230 | 5/1996 | Scarlata et al. | 271/186 |

FOREIGN PATENT DOCUMENTS

| | | | |
|---|---|---|---|
| 0 356 150 | 2/1990 | European Pat. Off. | 271/228 |
| 0 606 721 A1 | 7/1993 | European Pat. Off. | B65H 29/40 |
| U-91 16 582 | 1/1993 | Germany . | |
| 62 215459 | 9/1987 | Japan | 271/227 |
| 62-215459 | 9/1987 | Japan . | |
| 63-1668 | 1/1988 | Japan . | |
| 63-37039 | 2/1988 | Japan . | |
| 63-180635 | 7/1988 | Japan . | |
| 6 263287 | 9/1994 | Japan | 271/227 |
| 2 104 877 | 8/1982 | United Kingdom | B65H 29/40 |
| 2 122 008 | 6/1983 | United Kingdom | G07F 7/04 |
| 2114103 | 1/1988 | United Kingdom | 271/94 |
| 2 194 777 | 3/1988 | United Kingdom | B65H 29/40 |
| 2 196 323 | 4/1988 | United Kingdom . | |

*Primary Examiner*—H. Grant Skaggs
*Assistant Examiner*—Wonki Park
*Attorney, Agent, or Firm*—Townsend and Townsend and Crew LLP

[57] ABSTRACT

Sheet feeding apparatus includes a sheet feed device which operates to feed sheets towards or away from a sheet store. The sheet feed device has at least one resilient portion which flexes against its resilience relative to the remainder of the sheet feed device in response to contact with a sheet in the sheet store. A monitoring system is used to monitor the degree of flexure of the resilient portion to determine how full the sheet store is.

19 Claims, 5 Drawing Sheets

SHEET FEEDING APPARATUS AND METHOD

FIELD OF THE INVENTION

The invention relates to methods and apparatus for feeding sheets.

Such methods and apparatus can be used within equipment for counting, sorting, dispensing, accepting or recirculating sheets, documents and security documents such as banknotes and cheques.

DESCRIPTION OF THE PRIOR ART

In such equipment, a sheet store is normally provided and, depending upon the function of the equipment, sheets are fed to and/or withdrawn from the store by the sheet feeding apparatus. When sheets are being fed to the store, it is important to know when the store is full and to ensure that the enlarging stack does not interfere with the sheet feeding apparatus and when withdrawing sheets from the store, it is important to ensure that sheets are urged towards the sheet feeding apparatus in an acceptable manner to achieve accurate feeding. In the past, this has been achieved by monitoring the position of a stack within the store using suitable sensors. However, there is a need to provide a more convenient and accurate method.

The stacker arrangement whereby sheets are transported to enter a slot in a spiral or involute stacking wheel or set of wheels to then be transported by the rotating wheel either to be stacked against a sprung support plate or simply unsupportedly into a box, is well known. It is also a well established practice to count, using the control logic and sensor feedback of the sheet transporting system, the sheets as they enter the stacking position and upon a predetermined count of sheets being reached, to issue a "stacker full" signal and to stop the main transport or divert sheets destined for the stacker to an alternative empty stacker. Generally, then, detectors are used to determine the stacker has been emptied of sheets to indicate the stacker is in readiness to again receive sheets. This in the main requires all the sheets to be removed.

SUMMARY OF THE INVENTION

In accordance with one aspect of the present invention, sheet feeding apparatus comprises a sheet feed device which cooperates in use with a sheet store to feed sheets to and/or from the sheet store, the sheet feed device having at least one resilient portion which flexes against its resilience relative to the remainder of the sheet feed device in response to contact with a sheet in the sheet store; and a monitoring system for monitoring the degree of flexure of the resilient portion.

We have realised that it is possible to utilise the sheet feed device itself to monitor the sheet stack thus avoiding the need for separate sets of sensors depending upon the condition to be monitored.

Typically, the sheet feeding apparatus will be incorporated in sheet handling apparatus having a sheet store including a movable support against which sheets are stacked in use; and a control system responsive to signals from the monitoring system to cause movement of the sheet store support towards and/or away from the sheet feeding apparatus and/or to control operation of the sheet feeding apparatus depending upon the degree of flexure which is monitored and the type of sheet feed operation being performed.

The action of the control system will depend upon the function of the sheet handling apparatus. If the apparatus is for accepting sheets, such as a cash acceptor, then the control system will be adapted to move the support of the sheet store away from the sheet feeding device to allow room for additional sheets to be stacked until it has been moved to its fullest extent at which point the control system can stop operation of the sheet feed device.

When the sheet handling apparatus is adapted to dispense sheets, the control system can be arranged to move the support in the sheet store to urge the stack against the sheet feed device at a pressure which is maintained at an acceptable level.

Where the sheet handling apparatus is adapted both for accepting and dispensing sheets then the control system will be adapted to operate in accordance with the particular function being carried out.

It should be understood that the monitoring system could in some cases simply provide an output signal which controls a display to enable an operator to monitor operation of the apparatus. However, it is particularly preferred if some form of automatic feedback control is provided as described above.

The monitoring system also enables the position of the sheet feed device to be controlled, for example to indicate when the resilient portion contacts a sheet in the sheet store prior to a withdrawal operation.

Typically, the resilient portion or one or all of the resilient portions if more than one is provided will have means for withdrawing sheets from the store. The withdrawal means could comprise a high friction portion such as a high friction insert or a vacuum port connected in use to a vacuum source.

In addition, or alternatively, the resilient portion may define part of a sheet receiving slot into which sheets are fed in use for subsequent transfer to the sheet store. If more than one resilient portion is provided then only some of these could be used to define sheet receiving slots, in some cases.

It is particularly advantageous, however, to form the resilient portion as an active part of the sheet feed device, such as withdrawal means or a sheet receiving slot, although this is not essential and a resilient portion could be provided separate from these other parts.

In some cases, the sheet feed device could comprise a linearly movable member but conveniently it comprises at least one rotatably mounted member which, on rotation, carries sheets towards and/or away from the sheet store. In this case, the resilient portion preferably comprises a tine extending in a spiral fashion.

The monitoring system can be provided in a number of different ways and could be a contact or non-contact system. Preferably, however, the monitoring system is a non-contact system such as an optical system for optically detecting flexure of the resilient portion. For example, the optical system could include an optical source and a cooperating optical detector positioned on opposite sides of the sheet feed device.

BRIEF DESCRIPTION OF THE DRAWINGS

Some examples of sheet handling apparatus incorporating sheet feeding apparatus and for performing methods according to the invention will now be described with reference to the accompanying drawings, in which.

DETAILED DESCRIPTION OF EMBODIMENTS

Figure 2:
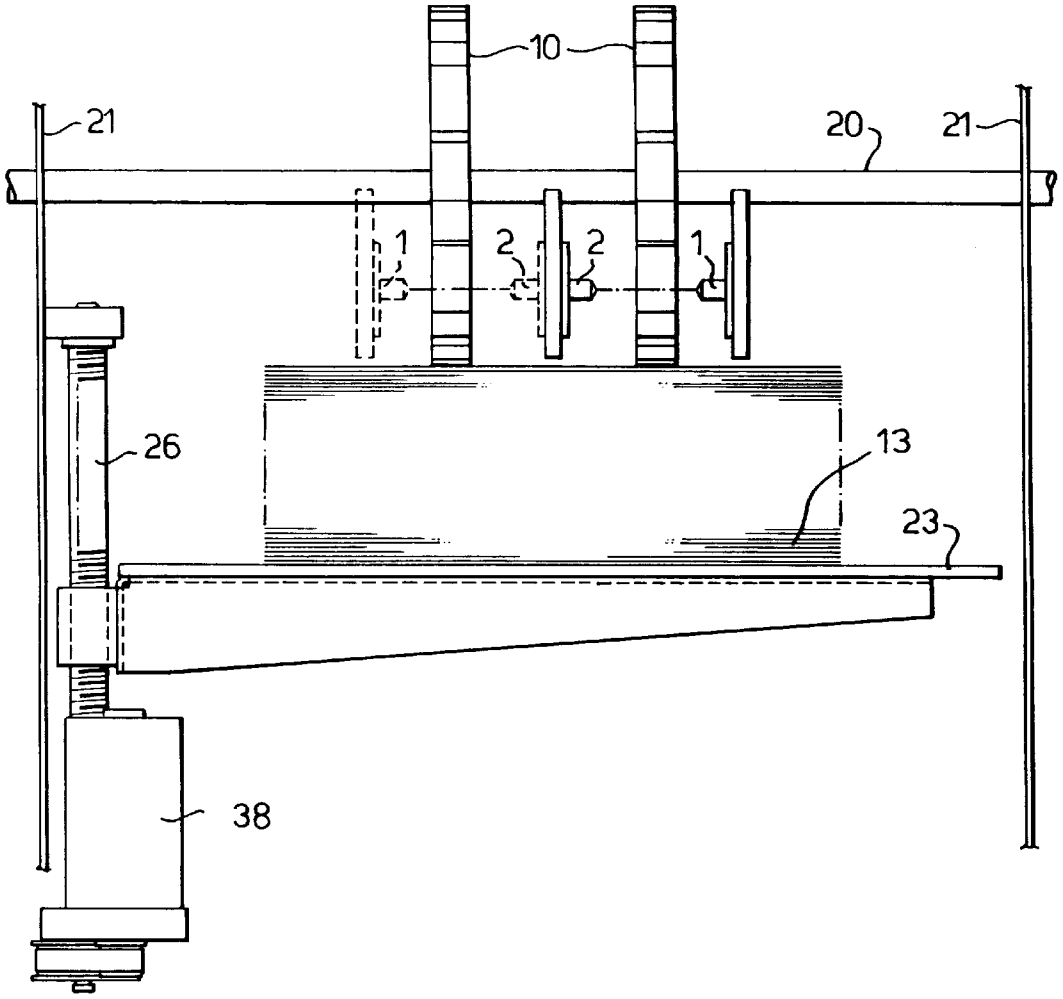
FIG. 2 is a front view of the module shown in FIG. 1.
Figure 1:
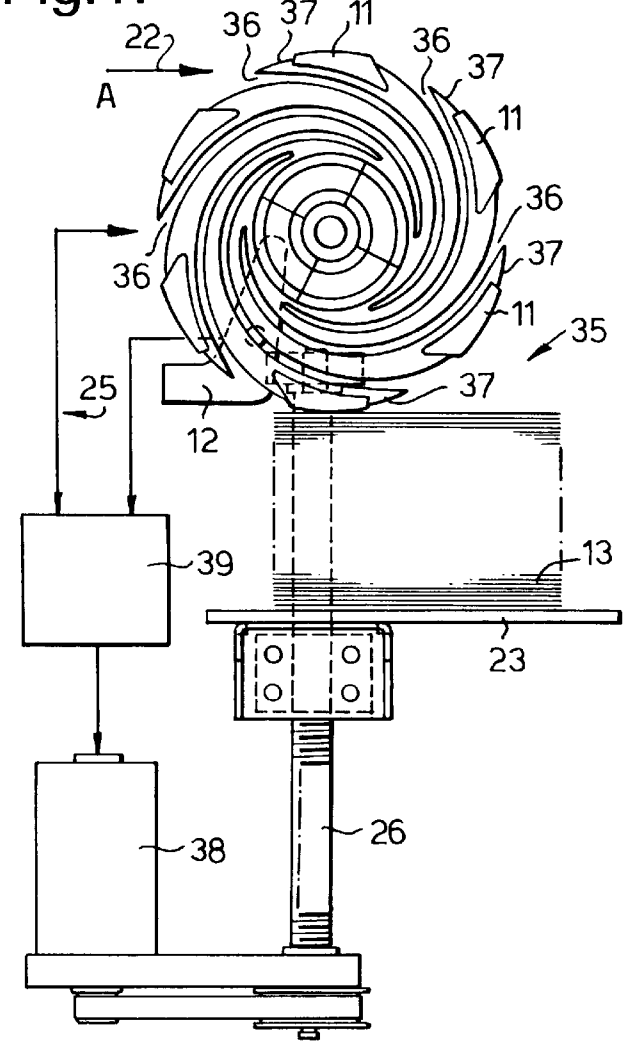
FIG. 1 is a side view of part of one example of the apparatus in the form of a sheet stack/feeding module with one module side plate removed.

FIGS. 1 and 2 show an example of the invention embodied in a sheet stacker/feeder module of an automatic banknote recirculating machine.

Two sheet feed devices in the form of involute feeding/stacking wheels 10 non-rotatably mounted to a shaft 20 rotatably mounted between side plates 21 are positioned between an inputting sheet transport system 22 (not shown in detail), a sheet stack support plate 23 (forming the base of a sheet store 35) slidably mounted on vertical runners (not shown) and an outputting sheet transport path 25 (not shown in detail). The shaping, construction and material of each feeding/stacking wheel 10 is such as to enable local portions 37 of the outer circumferential surface of the wheel to be deflected generally towards the axis of the wheel when an external force is applied to the surface. Conveniently, in the example being described, this is provided by radially curved sheet receiving slots 36 provided in each of the involute feeding/stacking wheels to accommodate sheets transported into the slots for transfer to the top of the stack of sheets 13 during a sheet stacking operation. The feeding/stacking wheels have high coefficient of friction polymer segments 11 mounted to each portion 37 as more fully described in our copending European Patent Application No. 96303451.7.

Shaft 20 is controllably driven by a drive motor (not shown).

One or more light emitting diodes 1 are positioned on one side of each wheel 10 to radiate a signal through the slots 6 in the feeding/stacking wheels 10 adjacent the stacking position, as the slots pass the LEDs, and substantially towards cooperating receivers 2 positioned on the opposite side of the wheels 10.

The positioning of each transmitter/receiver pair 1,2 is such that deflection of a feeding/stacking wheel portion 37 adjacent the stacking position affects the received signal.

Vertical travel of the plate 23 is caused by a lead screw 26 driven by a motor 38.

Control electronics 39 is provided for controlling operation of the motor 38 and the motor used to rotate the shaft 20. The control electronics 39 is also connected to the detectors 2 as shown. In addition, the control electronics 39 will receive control information in a conventional manner concerning overall operation of the equipment.

The control electronics 39 is adapted to control operation of the motor 38 such that when there are no sheets on the plate 23 or sheets are to be accumulated on the plate or no sheets are being transported to the stack the plate position is controlled to provide a clearance between the plate 23 or the uppermost note on the stack of sheets on the plate and the wheel 10. When sheets are to be fed from the store 35, the control electronics 39 controls the motor 38 to move the plate 23 to cause the uppermost sheet on the stack to be urged adjacent the portions or splines 37 of the involute feeding/stacking wheels 10. One or more guides (not shown) generally support the leading edge of sheets supported on the plate 23.

The operation of the apparatus will now be described: To store sheets, the sheets enter the transport at point A in the direction indicated by the arrow. The stacking wheels 10 are initially stationary and located as shown in the FIG. 1, and the support plate 23 has its position controlled such that a clearance exists between the plate 23 or the uppermost sheet of the stack 13 of previously stacked sheets and the stacking wheels 10. The operating system indicates to the control electronics 39 that a sheet stacking sequence is to commence. The first sheet to be stacked progresses to be fully entered into the aligned pair of slots 36 in each feeding/stacking wheel 10 which are opposite the transport system 22. The feeding/stacking wheels 10 are rotatably accelerated (as if they are mounted on a solid shaft) from their static position and stopped to align the next slots 36 with the sheet input point A. The next sheet is fed into the vacant slots 36 on the parked stacking wheels 10 and the process repeated until the control electronics 39 recognises that the final sheet of the batch to be stacked has entered the wheels and has been transported to the stack position. The sheets are conveyed in the slots 36 of the stacking wheels 10 until they are stripped from the stacking wheels by a set of guides 12 and deposited onto the stack of sheets 13.

The stack of sheets is lowered as required to maintain the gap between the stacking wheels 10 and the upper sheet of the stack of sheets by suitably controlling the motor 38. The motor 38 is controlled from the control electronics 39 which in turn monitors the signal received from the detectors 2. As the stack 13 builds up, successive portions 37 of the stacking wheels 10 will be urged further towards the axis of the stacking wheels thereby reducing the amount of light reaching the detectors 2. The control electronics 39 compares the received light intensity with a predetermined threshold and when the threshold is passed, indicating that the flexible portion 37 has flexed beyond a limit, the motor 38 is activated to rotate the lead screw 26 and move the plate 23 downwards.

The operation described above is intermittent but could be continuous.

To feed sheets from the stack, the control electronics 39 commences a sheet dispensing cycle. The support plate 23 is lifted until the uppermost sheet of the stack 13 makes sufficient contact pressure with the facing splines 37 of the feeding/stacker wheels 10 and the stacking wheel segments 11, to cause the splines 37 to deflect sufficiently to affect the signal received by receiver 2 which is used to determine adequate contact pressure exists between the wheels 10 and or segments 11 and the contacting sheet. The rotation or stepped rotation of the wheels 10 is then commenced so that the uppermost sheet in the stack is urged by the cooperating segments 11 to enter the exiting transport 25. Sensors (not shown) register each sheet as it is fed and rotation of the wheels 10 continues until the completion of the dispensing cycle. As feeding continues the support plate 23 is raised to maintain the contact pressure between the uppermost sheet of the stack and the feeding/stacking wheel and its segments as determined by monitoring the signals received by the detectors 2.

Figure 3A:
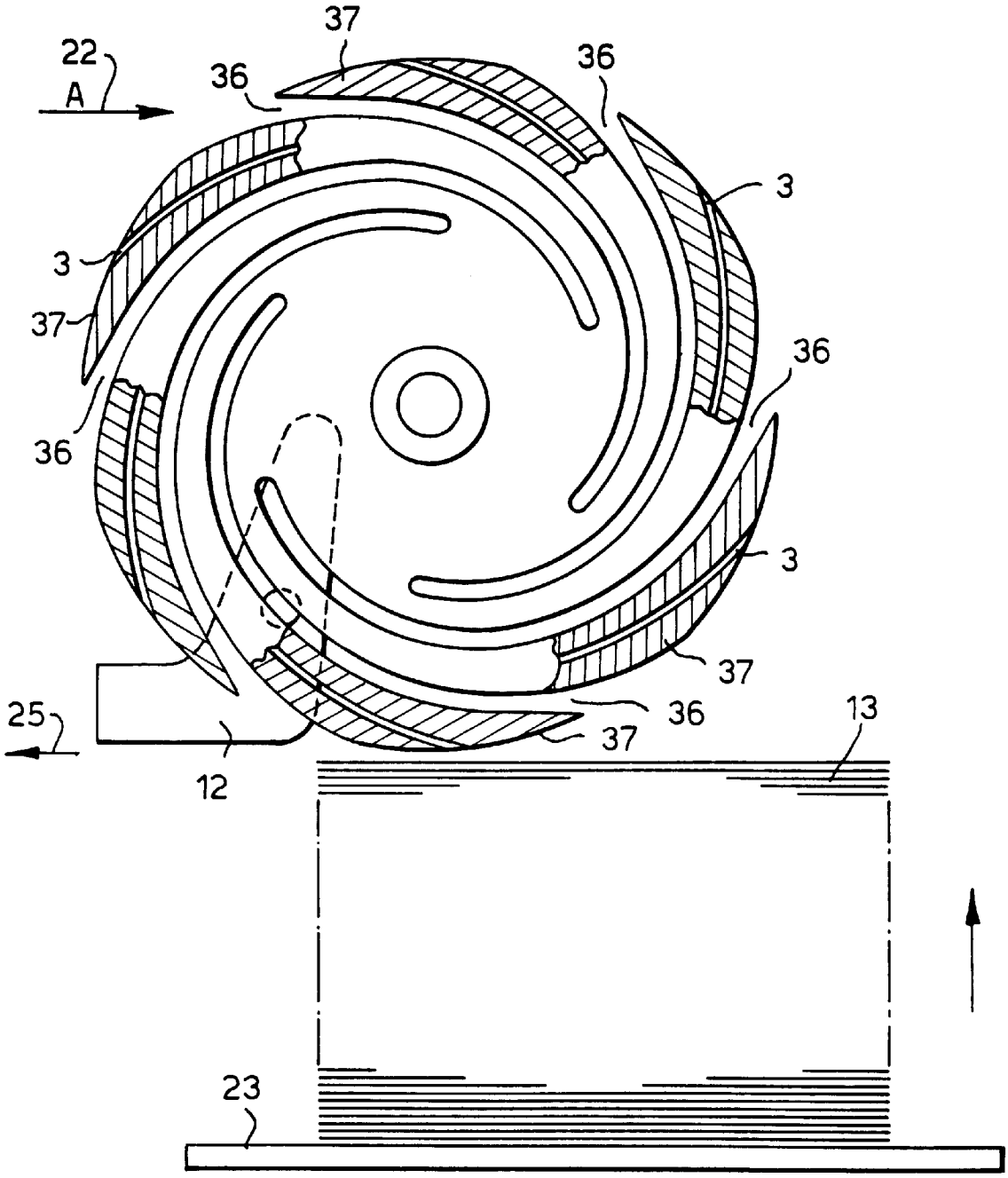
FIG. 3A is a side view similar to FIG. 1 but of a second example.
Figure 3B:
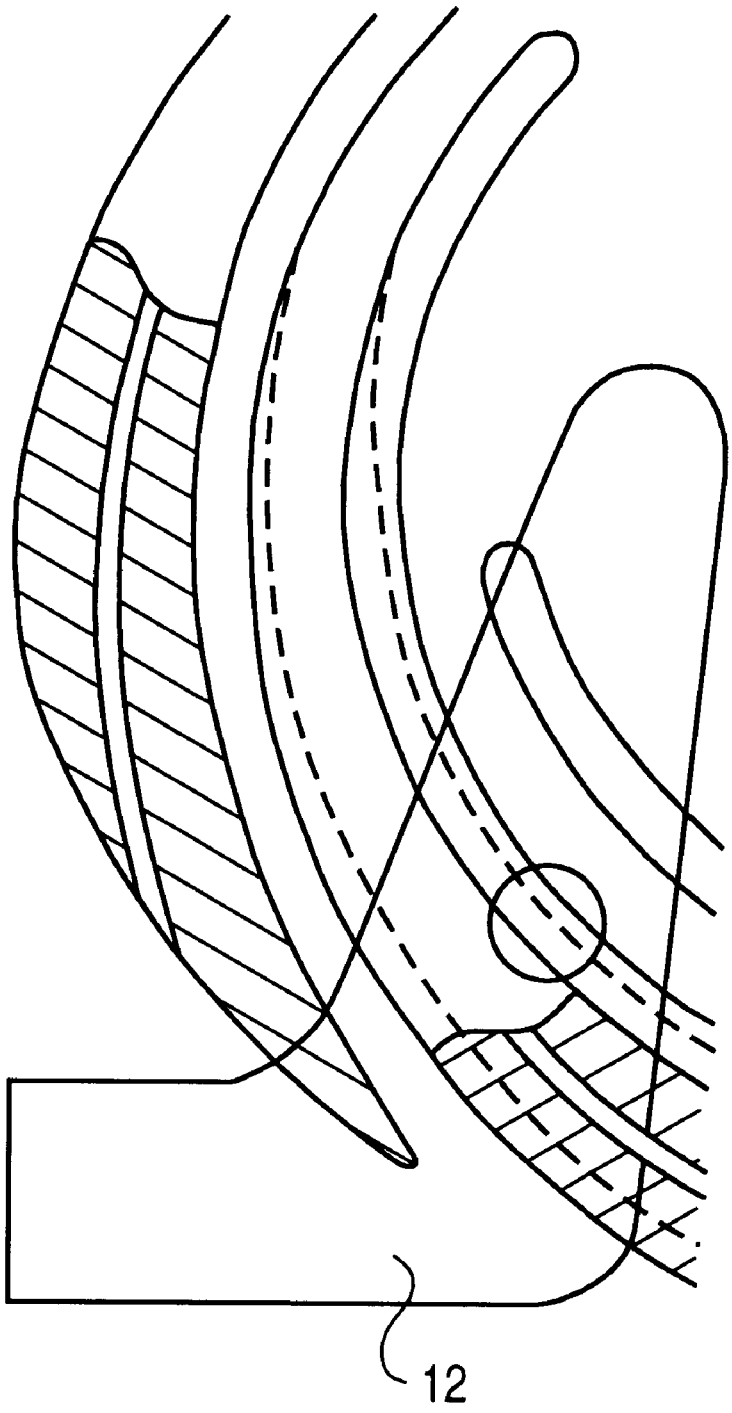
FIG. 3B is a fragmentary view of FIG. 3A showing the flexure of one of the resilient portions.

An alternative wheel 10 is shown in FIG. 3A. In this wheel, each portion or tine 37 has a port 3 extending through it and communicating with a vacuum source (not shown). The operation of this device is much the same as that described above excepting that when dispensing sheets from the stack the porting 3 is connected to a vacuum source during the section of rotation when the top sheet of the stack is to be fed from the stack 13 towards the transport dispensing point 25, in order temporarily to attach the sheet to the spline's outer surface whilst the wheel 10 is rotating. FIG. 3B is a fragmentary view of FIG. 3A showing the flexure of one of tines 37, with the flexed position shown in phantom. As can be seen, slot 36 is narrowed, thereby changing the amount of light that reaches the detector 2.

The examples described above relate to equipment for accepting and dispensing sheets. The use of the invention in a second configuration i.e. in a sheet stacking arrangement only, will now be described by reference to FIG. 4.

Figure 4:
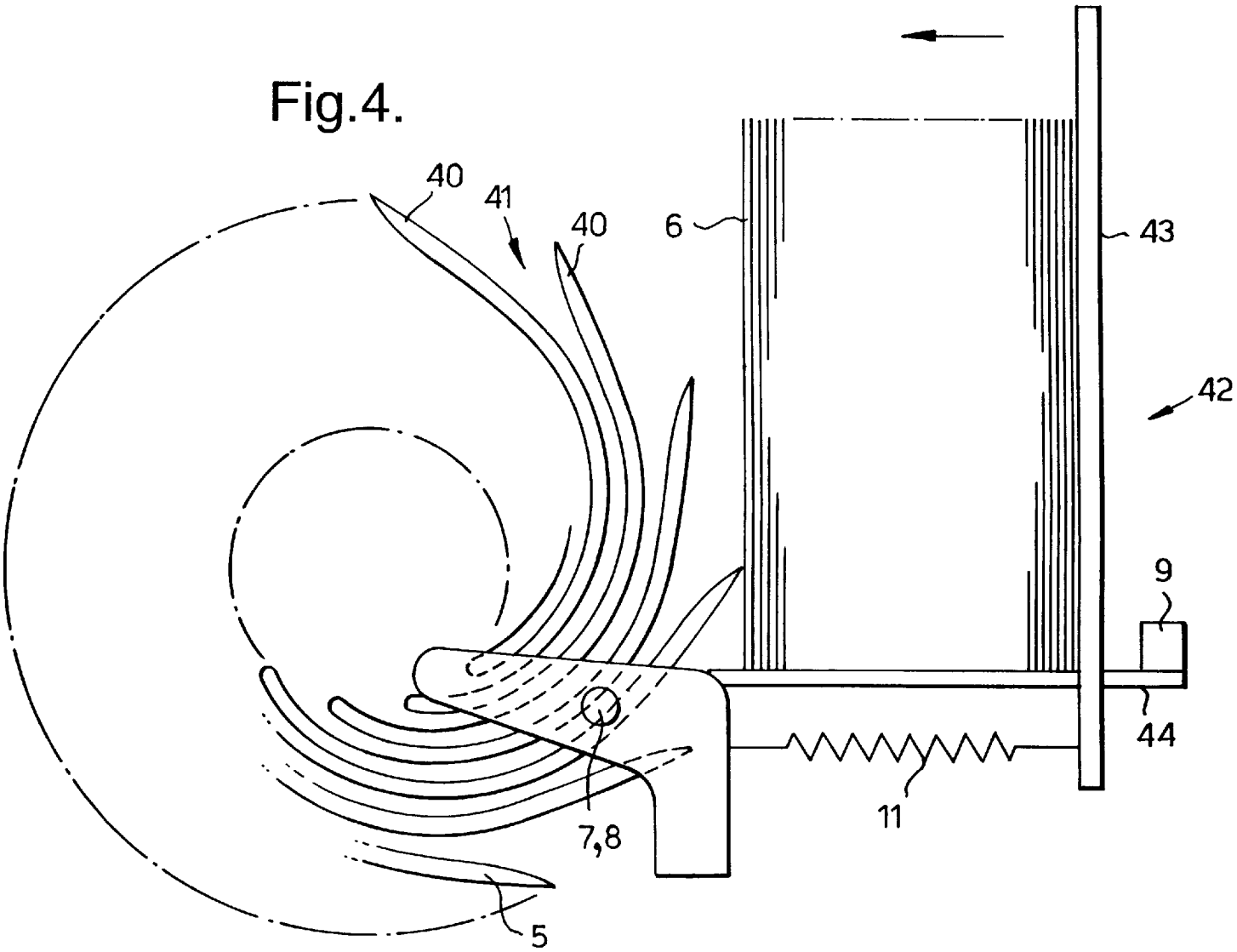
FIG. 4 is a side view of part of a third example of sheet handling apparatus used in a sheet stacking configuration.

FIG. 4 shows the invention being used in a stacking configuration that can provide a continuous feedback as to the status of the length of the stack, which can be used to indicate the stacker is full and which does not require the stacker to be fully emptied before the stacker can be used again.

In this example, a stacker wheel 5 of conventional construction is provided having sets of tines 40 defining sheet receiving slots 41 between them. A sheet store 42 comprises an end plate 43 which is movable towards and away from the stacking wheel 5 and is urged towards the stacker wheel 5 by a spring 11. Sheets 6 rest on a plate 44 on which is mounted an end stop 9 against which the plate 43 abuts when the store is full. As in the previous examples, a light source and light detector indicated at 7,8 are provided on opposite sides of the wheel 5 to detect flexure of the tines 40 which engage the nearest sheet in the stack.

Again the shaping, construction and material of each feeding/stacking wheel is such as to enable local segments of the outer circumferential surface of the wheel to be deflected generally towards the axis of the wheel when an external force is applied to the surface. Conveniently, in the example being described, this is provided by the radially curved slots provided in each of the involute feeding/stacking wheels to accommodate sheets transported into the slots for transfer to the stack of sheets 6 supported by the spring loaded plate 43.

Thus from the state when there are no sheets in the sheet store up to the point when the support plate 43 touches its stop 9 as the sheets are stacked, the tine(s) of the stacking wheel(s) 5 adjacent the stack will be caused to deflect by the combined influences of the support plate spring 11, the spring characteristics of the stack of sheets 6 and the characteristics of the wheel(s) 5. With the support plate against the stop 9 the tine deflection rate will increase and this will be detected by the control electronics 39 which, once a flexure threshold is reached, will stop rotation of the wheel(s) 5 and/or provide an indication signal that the stacker is becoming full or is full. Thus, with removal of some or all of the sheets from the stack, the operation of the stacker can be continuous.

Whereas the above examples of the invention and use of the invention are concentrated about implementations using spiral or involute stacking/feeding wheels and the use of leds and receivers to detect the deflection imparted to the tines of the wheels, other implementations are envisaged. For example, Hall Effect devices may be used for detection purposes and or alternative means of relieving the body of the feeding/stacking wheel to provide means for flexing the wheel surface as shown by FIGS. 5 and 6 could be used.

Figure 5A:
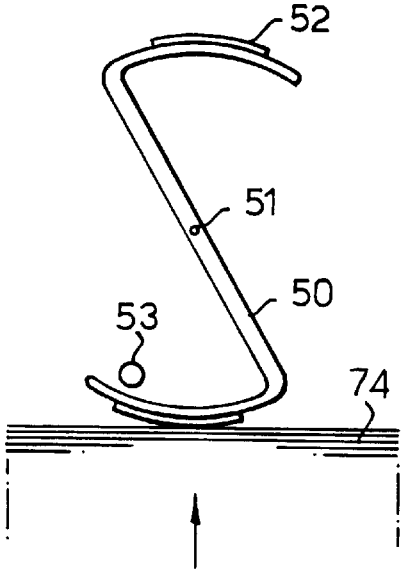
FIGS. 5A and 5B illustrate side views of two different sheet feed devices.

The sheet feed device shown in FIG. 5A comprises an S-shaped member 50 which is rotatably mounted about its axis 51, outer surfaces of the ends of the S being flexible and having a relatively high friction surface 52. A detector system 53 is provided as before. This sheet feed device is provided solely for dispensing sheets from a stack 74.

Figure 5B:
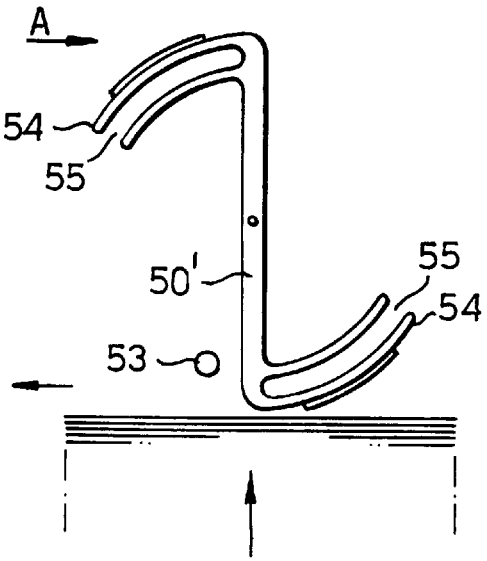

In the FIG. 5B example, the device shown in FIG. 5A has been modified to a device 50' having U-shaped arms 54 at each end defining sheet receiving slots 55. The outermost arm 54 is flexible as in other examples and its position can be monitored using the detector system 53.

Figure 6:
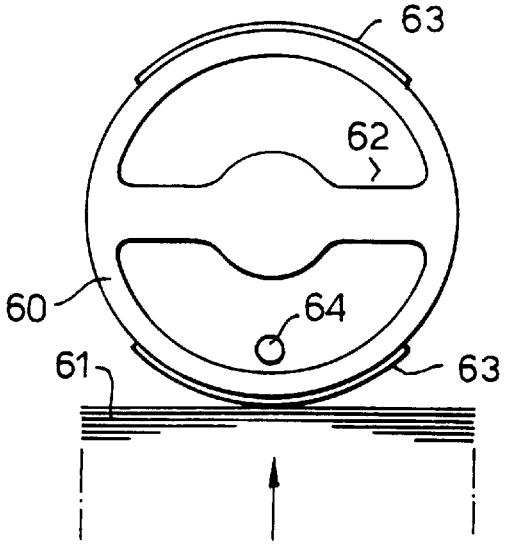
FIG. 6 is a side view of a further example of a sheet feed device.

FIG. 6 illustrates a wheel 60 for dispensing sheets only from a stack 61, the wheel 60 having a generally circular form with a central web 62 extending across a diameter. Diametrically opposite portions 63 of the wheel 60 are provided with high friction surfaces and a detector system 64 is provided for monitoring flexure of each portion 63 adjacent the stack 61.

I claim:

1. Sheet handling apparatus comprising:

a sheet store including a movable support against which sheets are stacked;

a sheet feed device which cooperates with said sheet store to feed sheets with respect to said sheet store, the sheet feed device comprising at least one rotatably mounted member having at least one resilient portion which flexes against its resilience relative to the remainder of said rotatably mounted member in response to contact with a sheet in said sheet store;

a monitoring system for monitoring the degree of flexure of said resilient portion relative to the remainder of said rotatably mounted member;

a drive mechanism for moving the sheet store with respect to the sheet feed device; and a control system that cooperates with the drive mechanism in response to signals from said monitoring system to cause movement of said sheet store support relative to said sheet feeding apparatus.

2. Apparatus according to claim 1, wherein said at least one resilient portion has means for withdrawing sheets from said sheet store.

3. Apparatus according to claim 2, wherein said withdrawal means comprises a portion having a surface that frictionally engages the sheets to be withdrawn.

4. Apparatus according to claim 2, wherein said withdrawal means comprises a vacuum port for connection to a vacuum source.

5. Apparatus according to claim 1, wherein said at least one resilient portion defines part of a sheet receiving slot into which sheets are fed for subsequent transfer to said sheet store.

6. Apparatus according to claim 1, wherein said at least one rotatably mounted member, on rotation in a sheet stacking mode, carries sheets towards said sheet store, and, on rotation in a sheet dispensing mode, urges sheets away from said sheet store.

7. Apparatus according to claim 6, wherein said at least one resilient portion defines part of a sheet receiving slot into which sheets are fed for subsequent transfer to said sheet store, wherein said at least one resilient portion comprises a tine extending in a spiral fashion.

8. Apparatus according to claim 6, wherein said sheet feed device has a plurality of resilient portions circumferentially spaced around the device.

9. Apparatus according to claim 1, wherein said monitoring system comprises an optical system for optically detecting flexure of said at least one resilient portion.

10. Apparatus according to claim 9, wherein said optical system includes an optical source and a cooperating optical detector positioned on opposite sides of said sheet feed device.

11. Apparatus according to claim 10, wherein said optical source comprises a light emitting diode.

12. A method of operating sheet handling apparatus according to claim 1 so as to withdraw sheets from the store, the method comprising:

a) monitoring the degree of flexure of the resilient portion of the sheet feed device facing the store;

b) comparing the monitored flexure with a predetermined threshold;

c) if the monitored flexure is less than the predetermined threshold, causing the movable support to move towards the sheet feed device until the monitored flexure is not less than the predetermined threshold;

d) operating the sheet feeding apparatus to withdraw sheets from the store; and, e) repeatedly monitoring the degree of flexure of the resilient portion passing the store and moving the movable support accordingly to maintain the monitored degree of flexure at or above the predetermined threshold.

13. A method of operating sheet handling apparatus according to claim 1, so as to feed sheets to the store, the method comprising:

a) repeatedly monitoring the degree of flexure of the resilient portion passing the store;

b) comparing the monitored flexure with a predetermined threshold; and c) if the monitored flexure exceeds the predetermined threshold, either causing the movable support to move away from the sheet feed device or stopping operation of the sheet feed device.

14. Apparatus according to claim 1, wherein:

said sheet feed device has both a sheet stacking mode and a sheet dispensing mode;

in said sheet stacking mode, said sheet feed device feeds sheets with respect to said sheet store such that sheets are fed to said sheet store; and in said sheet dispensing mode, said sheet feed device feeds sheets with respect to said sheet store such that sheets are fed from said sheet store.

15. Sheet handling apparatus comprising:

a sheet store including a movable support against which sheets are stacked;

a sheet feed device which cooperates with said sheet store to selectively (a) feed sheets to said sheet store in a sheet stacking mode, or (b) to feed sheets from said sheet store in a sheet dispensing mode, the sheet feed device comprising at least one rotatably mounted member having at least one resilient portion which flexes against its resilience relative to the remainder of said rotatably mounted member in response to contact with a sheet in said sheet store;

a monitoring system for monitoring the degree of flexure of said resilient portion relative to the remainder of said rotatably mounted member;

a drive mechanism for moving the sheet store with respect to the sheet feed device; and a control system that cooperates with the drive mechanism in response to signals from said monitoring system to cause (a) movement of said sheet store support toward said sheet feed device during said sheet dispensing mode when said monitored flexure indicates an insufficient degree of flexure for dispensing, and (b) movement of said sheet store support away said sheet feed device during said sheet stacking mode when said monitored flexure indicates an excessive degree of flexure for accepting sheets.

16. Apparatus according to claim 15, wherein said control system also operates in said sheet stacking mode to stop operation of the sheet feed device.

17. A method of feeding sheets with respect to a sheet store including a movable support against which sheets are stacked, the method comprising:

providing a sheet feed device which cooperates with the sheet store to feed sheets with respect to the sheet store, the sheet feed device comprising at least one rotatably mounted member having at least one resilient portion which flexes against its resilience relative to the remainder of the rotatably mounted member in response to contact with a sheet in the sheet store;

generating a signal representative of the degree of flexure of the resilient portion relative to the remainder of the rotatably mounted member; and using the signal representative of the degree of flexure to control at least one of (a) the position of the movable support, and (b) the operation of the sheet feed device.

18. A method according to claim 17, wherein using the signal representative of the degree of flexure comprises:

comparing the signal representative of the degree of flexure with a predetermined threshold;

if the signal representative of the degree of flexure is less than the predetermined threshold, causing the sheet store support to move towards the sheet feed device until the signal representative of the degree of flexure is not less than the predetermined threshold;

operating the sheet feed device to withdraw sheets from the store; and repeatedly comparing the signal representative of the degree of flexure with the predetermined threshold and moving the sheet store base accordingly to maintain the signal representative of the degree of flexure at or above the predetermined threshold.

19. A method according to claim 17, wherein using the signal representative of the degree of flexure comprises:

b) comparing the signal representative of the degree of flexure with a predetermined threshold; and c) if the signal representative of the degree of flexure exceeds the predetermined threshold, either causing the movable support to move away from the sheet feed device or stopping operation of the sheet feed device.

* * * * *